US009396637B2

(12) United States Patent
Chandler et al.

(10) Patent No.: US 9,396,637 B2
(45) Date of Patent: Jul. 19, 2016

(54) PHOTOELECTRIC SMOKE DETECTOR WITH DRIFT COMPENSATION

(71) Applicant: WALTER KIDDE PORTABLE EQUIPMENT, INC., Mebane, NC (US)

(72) Inventors: Bill Chandler, Colorado Springs, CO (US); Larry R. Ratzlaff, Elgin, IL (US); Dave Bush, Wheatland, WY (US)

(73) Assignee: WALTER KIDDE PORTABLE EQUIPMENT, INC, Mebane, NC (US)

( * ) Notice: Subject to any disclaimer, the term of this patent is extended or adjusted under 35 U.S.C. 154(b) by 420 days.

(21) Appl. No.: 13/898,773

(22) Filed: May 21, 2013

(65) Prior Publication Data

US 2014/0015680 A1 Jan. 16, 2014

Related U.S. Application Data

(60) Provisional application No. 61/671,557, filed on Jul. 13, 2012.

(51) Int. Cl.

| | |
|---|---|
| ***G08B 17/00*** | (2006.01) |
| ***G08B 17/12*** | (2006.01) |
| ***G08B 17/107*** | (2006.01) |
| ***G08B 29/26*** | (2006.01) |

(52) U.S. Cl.

CPC ..... *G08B 17/12* (2013.01); *G08B 17/107* (2013.01); *G08B 29/26* (2013.01)

(58) Field of Classification Search

CPC ..... G08B 17/107; G08B 17/12; G08B 29/26
See application file for complete search history.

(56) References Cited

U.S. PATENT DOCUMENTS

| | | | |
|---|---|---|---|
| 4,222,046 | A | 9/1980 | Pinckaers et al. |
| 5,172,096 | A | 12/1992 | Tice et al. |
| 5,473,314 | A | 12/1995 | Mochizuki et al. |
| 5,523,743 | A | 6/1996 | Rattman et al. |
| 5,543,777 | A | 8/1996 | Vane et al. |
| 5,552,765 | A | 9/1996 | Vane et al. |
| 5,629,671 | A | 5/1997 | Morita |
| 5,699,043 | A | 12/1997 | Vane et al. |

(Continued)

FOREIGN PATENT DOCUMENTS

| | | | |
|---|---|---|---|
| AU | 2005278910 | A1 | 3/2006 |
| CA | 2198483 | A1 | 3/1996 |

(Continued)

*Primary Examiner* — Omeed Alizada
(74) *Attorney, Agent, or Firm* — Cantor Colburn LLP

(57) ABSTRACT

A smoke detector is disclosed that comprises a smoke detection chamber comprising: a light source operable to provide radiation to an interior space of the smoke detection chamber, and a light detector operable to receive radiation scattered by one or more radiation scatting particles in the interior of the smoke detection chamber; an alarm control module, in communication with the smoke detection chamber and a processor, operable to produce an alarm indicating a presence of a predetermined threshold of the one or more radiation scattering particles; a computer readable medium comprising instructions that when executed by the processor, cause the detector to perform an alarm compensation threshold method comprising: comparing a calibrated clear air voltage measurement with an average clear air voltage measurement; adjusting an alarm threshold sensitivity, based at least in part, on the comparison of the calibrated clear air voltage measurement and the average clear air voltage measurement.

7 Claims, 6 Drawing Sheets

(56) References Cited

U.S. PATENT DOCUMENTS

| | | | | |
|---|---|---|---|---|
| 5,705,988 | A | 1/1998 | McMaster | |
| 5,708,414 | A | 1/1998 | Peltier et al. | |
| 5,721,529 | A | 2/1998 | Vane et al. | |
| 5,798,701 | A | 8/1998 | Bernal et al. | |
| 5,821,866 | A | 10/1998 | Bernal et al. | |
| 5,936,533 | A | 8/1999 | Bernal et al. | |
| 6,060,991 | A | 5/2000 | Hsieh | |
| 6,111,511 | A | 8/2000 | Sivathanu et al. | |
| 6,396,405 | B1 | 5/2002 | Bernal et al. | |
| 6,437,698 | B1 | 8/2002 | Byrne et al. | |
| 6,583,404 | B1 | 6/2003 | Sakurai | |
| 6,756,906 | B2 | 6/2004 | Bernal et al. | |
| 7,224,284 | B2 | 5/2007 | Mi et al. | |
| 7,412,356 | B1 | 8/2008 | Dzenitis et al. | |
| 7,474,226 | B2 | 1/2009 | Mi et al. | |
| 8,203,456 | B2 | 6/2012 | Luo et al. | |
| 2001/0038338 | A1* | 11/2001 | Kadwell et al. | 340/630 |
| 2004/0063154 | A1* | 4/2004 | Booth et al. | 435/7.1 |
| 2006/0261967 | A1* | 11/2006 | Marman et al. | 340/630 |
| 2010/0085199 | A1 | 4/2010 | Gonzales et al. | |
| 2011/0018726 | A1 | 1/2011 | Gonzales | |
| 2012/0140231 | A1* | 6/2012 | Knox et al. | 356/442 |
| 2012/0192577 | A1* | 8/2012 | Drake et al. | 62/80 |

FOREIGN PATENT DOCUMENTS

| | | | |
|---|---|---|---|
| CA | 2174175 | A1 | 10/1996 |
| DE | 102005060748 | B3 | 3/2007 |
| EP | 526898 | A1 | 2/1993 |
| EP | 580110 | A1 | 1/1994 |
| EP | 660283 | A1 | 6/1995 |
| EP | 714541 | A1 | 6/1996 |
| EP | 765513 | A1 | 4/1997 |
| EP | 777895 | A1 | 6/1997 |
| EP | 1100061 | A2 | 5/2001 |
| EP | 1552489 | A2 | 7/2005 |
| EP | 1798699 | A1 | 6/2007 |
| JP | H06036160 | A | 2/1994 |
| JP | H06150170 | A | 5/1994 |
| TW | 201007634 | A | 2/2010 |
| WO | 9607165 | A1 | 3/1996 |
| WO | 9632705 | A1 | 10/1996 |
| WO | 2006024960 | A1 | 3/2006 |
| WO | 2012044324 | A1 | 4/2012 |

* cited by examiner

PHOTOELECTRIC SMOKE DETECTOR WITH DRIFT COMPENSATION

CROSS REFERENCE TO RELATED APPLICATIONS

This application claims priority to U.S. Provisional Patent Application Ser. No. 61/671,557 filed on Jul. 13, 2012, the disclosure of which is incorporated by reference herein in its entirety.

FIELD OF INVENTION

The present disclosure relates generally to smoke detectors and smoke alarms, in particular, to smoke detectors and alarms with alarm threshold compensation.

DESCRIPTION OF RELATED ART

Photoelectric-type smoke detector can include a light source, typically an LED, and a light detector that are mounted at an acute angle to each other inside a detection chamber that is shielded from stray light. Light emitted by the light source is scattered by smoke particles entering the detection chamber. The incidence of the scattered light on the light detector activates an alarm. The alarm sensitivity of photoelectric-type smoke detectors can be influenced by the presence of dust within the detection chamber and typically require routine maintenance to ensure proper functioning. What is needed is an improved photoelectric smoke detector that can adjust the alarm sensitivity to compensate for the presence of dust and other particulates.

BRIEF SUMMARY

According to aspects of the present disclosure, a smoke detector is disclosed that comprises a smoke detection chamber comprising: a light source operable to provide radiation to an interior space of the smoke detection chamber, and a light detector operable to receive radiation scattered by one or more radiation scatting particles in the interior of the smoke detection chamber; an alarm control module, in communication with the smoke detection chamber and a processor, operable to produce an alarm indicating a presence of a predetermined threshold of the one or more radiation scattering particles; a computer readable medium comprising instructions that when executed by the processor, cause the detector to perform an alarm compensation threshold method comprising: comparing a calibrated clear air voltage measurement with an average clear air voltage measurement; adjusting an alarm threshold sensitivity, based at least in part, on the comparison of the calibrated clear air voltage measurement and the average clear air voltage measurement.

In some aspects, the calibrated clear air voltage measurement can be established in substantially zero percent smoke free environment and saved in the memory.

In some aspects, the average clear air voltage measurement can be a running average of voltage measurements taken over a 24 hour period or over a predetermined time period sufficient to period to filter out transients and cycles that are not related to dust accumulation or infrared LED degradation and saved in the memory.

In some aspects, if the calibrated clear air voltage measurement is greater than the average clear air voltage measurement, then a degradation of the light source is indicated and the alarm threshold sensitivity is increased by an amount to compensate for decreased alarm sensitivity of the smoke detector.

In some aspects, if the calibrated clear air voltage measurement is less than the average clear air voltage measurement, then an increased amount of dust in the smoke detector is indicated and the alarm threshold sensitivity is decreased by an amount to compensate for increased alarm sensitivity of the smoke detector.

In accordance with aspects of the present disclosure, a smoke detector is disclosed that can comprise a smoke detection chamber comprising: a light source operable to provide radiation to an interior space of the smoke detection chamber, and a light detector operable to receive radiation scattered by one or more radiation scatting particles in the interior of the smoke detection chamber; an alarm control module, in communication with the smoke detection chamber and a processor, operable to produce an alarm indicating a presence of a predetermined threshold of the one or more radiation scattering particles; a computer readable medium comprising instructions that when executed by the processor, cause the detector to perform a clear air voltage averaging method comprising: determining if a clear air voltage average measurement is to be updated; obtaining, if the clear air voltage average measurement is determined to be updated, a new clear air voltage measurement from the smoke detection chamber; and updating the clear air voltage average using the new clear air voltage measurement.

In some aspects, the new clear air voltage measurement can be obtained during a predefined time interval.

In some aspects, the predefined time interval can be about every one hour.

In some aspects, the clear air voltage average is not updated if one or more of the following conditions are detected: a smoke fault, a fatal fault, standby mode, smoke calibration mode not complete.

In some aspects, the average clear air voltage measurement can be a running average of voltage measurements taken over a 24 hour period and saved in the memory.

In accordance with aspects of the present disclosure, a computer readable medium is disclosed that comprises instructions that when executed by a processor of a smoke detector, cause the smoke detector to perform an alarm compensation threshold method comprising: comparing a calibrated clear air voltage measurement with an average clear air voltage measurement; adjusting an alarm threshold sensitivity, based at least in part, on the comparison of the calibrated clear air voltage measurement and the average clear air voltage measurement.

In accordance with aspects of the present disclosure, a computer readable medium is disclosed that comprises instructions that when executed by a processor of a smoke detector, cause the smoke detector to perform a clear air voltage averaging method comprising: determining if a clear air voltage average measurement is to be updated; obtaining, if the clear air voltage average measurement is determined to be updated, a new clear air voltage measurement from the smoke detection chamber; and updating the clear air voltage average using the new clear air voltage measurement.

In accordance with aspects of the present disclosure, a computer-implemented method is disclosed that can be stored in a computer readable medium that comprises instructions that when executed by a processor of a smoke detector, cause the smoke detector to perform an alarm compensation threshold method comprising: comparing a calibrated clear air voltage measurement with an average clear air voltage measurement; adjusting an alarm threshold sensitivity, based at least in part, on the comparison of the calibrated clear air voltage measurement and the average clear air voltage measurement.

In accordance with aspects of the present disclosure, a computer-implemented method is disclosed that can be stored in a computer readable medium that comprises instructions that when executed by a processor of a smoke detector, cause the smoke detector to perform a clear air voltage averaging method comprising: determining if a clear air voltage average measurement is to be updated; obtaining, if the clear air voltage average measurement is determined to be updated, a new clear air voltage measurement from the smoke detection chamber; and updating the clear air voltage average using the new clear air voltage measurement.

In some aspects, the average clear air voltage measurement is a running average of voltage measurements taken over a predetermined time period sufficient to period to filter out transients and cycles that are not related to dust accumulation or infrared LED degradation and saved in the memory.

In some aspects, the clear air voltage average is not updated if one or more of the following conditions are detected: a smoke fault, a fatal fault, standby mode, smoke calibration mode not complete, or any detected abnormal operation or condition prevents CAV averaging.

In some aspects, the average can be a running average, updated, when possible, every hour. Compensation period can be set to 24 hours but could be a longer period, for example, between about 24 and 168 hours.

BRIEF DESCRIPTION OF THE SEVERAL VIEWS OF THE DRAWINGS

Referring now to the drawings wherein like elements are numbered alike in the FIGURES.

DETAILED DESCRIPTION

In general, aspects of the present disclosure relate to a smoke detector that can compensate for the presence of dust or for degradation of the light source. An accumulation of dust on walls of a detection chamber of the smoke detector can increase reflectivity of chamber and thereby acts as a significant secondary light source that, in the presence of a given level of smoke, counteracts the light attenuation induced by the smoke particles. Elimination of dirt and dust build-up would require constant cleaning, resulting in high maintenance costs. A smoke detector that is operable to compensate for dirt and dust build-up is discussed that provides in mechanism for smoke detector drift compensation.

Figure 1:
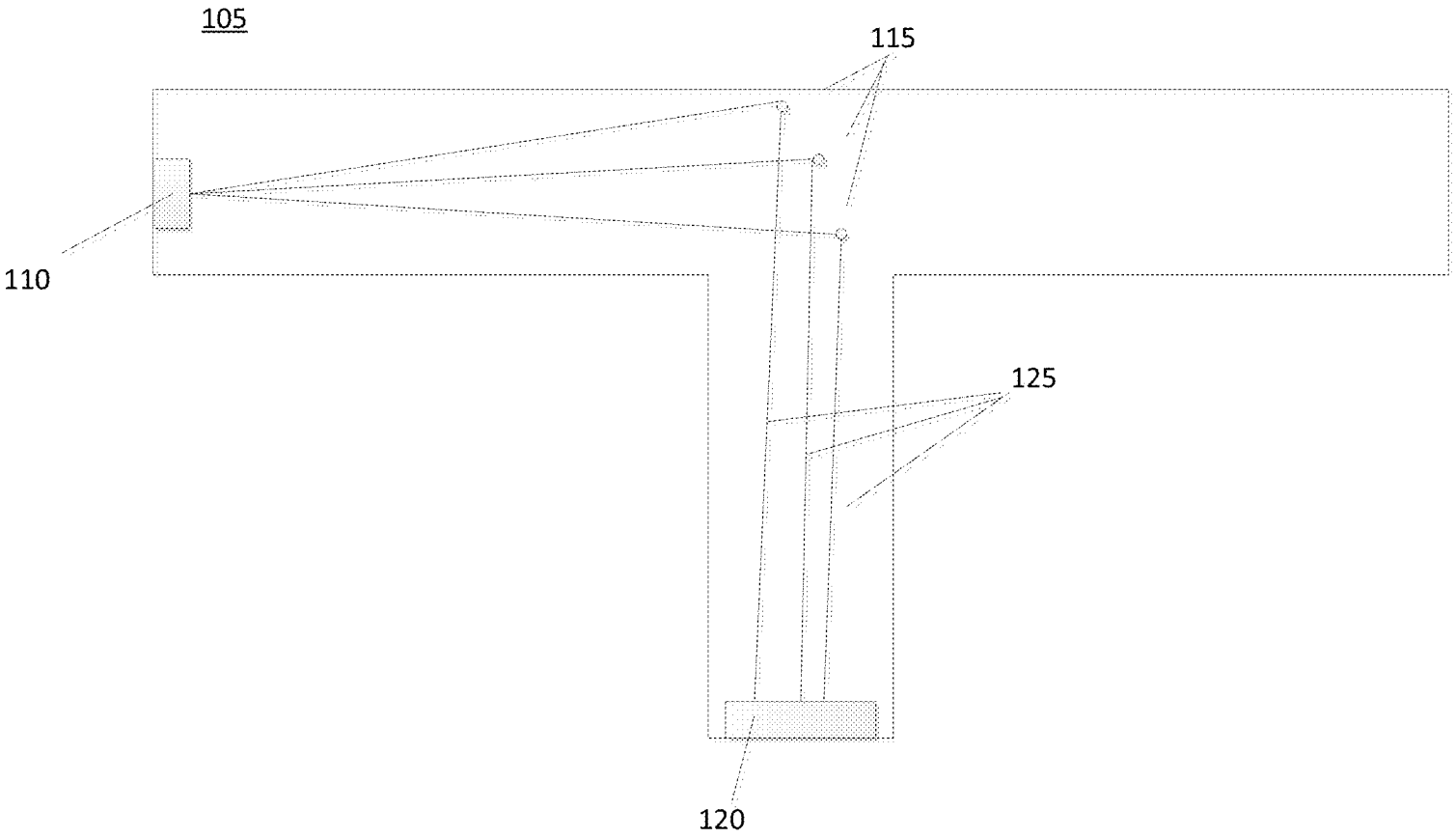
FIG. 1 shows an example of a smoke detection chamber of a smoke detector according to an embodiment of the disclosure.

FIG. 1 shows an example of a smoke detection chamber for a photoelectric smoke alarm. It should be readily apparent to one of ordinary skill in the art that the example smoke detection chamber depicted in FIG. 1 represents a generalized schematic illustration and that other components can be added, removed, or modified.

Referring to FIG. 1, inside the detector, light source 110 is operable to direct a narrow beam of infrared light across detection chamber 105. Light source 110 can be, for example, but not limited to a light emitting diode (LED). Other suitable light sources operable to produce infrared, ultraviolet, or visible light can also be used. When smoke or particles 115 enter chamber 105, the infrared light beam is scattered. Light detector 120, positioned at an angle, for example, 90 degrees, to the beam, can be operable to detect the scattered infrared light 125. When a preset amount of light is detected by photo detector 120, an alarm (discussed below) will sound. Light detector 120 can be, for example, but not limited to a photodiode or photodetector. Other suitable light detectors can also be used.

Light source 110 can be operable to emit pulses of light. Light detector 120 can be operable to measure corresponding light intensity incident on a light receiving surface (not shown) of light detector 120. The measured light intensity values can be recorded in a memory (discussed below). Light detector 120 is operable to detect the light propagating through an opening (not shown) of chamber 105 and, in response, produces an output signal that is used to produce an alarm signal. Under smoke-free conditions, light detector 120 receives a maximum light output of light source 110. If during a prescribed time interval there are multiple occurrences of light incident on light detector 120 falling below a threshold level in response to the presence of smoke particles in chamber 105, the output signal level of light detector 120 falls below the predetermined threshold for each occurrence and a comparator (not shown) sends a signal that generates an alarm. The threshold level can be a fixed light output value, a value established by rate of change of light output level, or a combination of both of them.

In implementations, the detector can be operable to use techniques, for example, but not limited to, including forward scattering, back scattering, and transmissive (obscuration).

Figure 2:
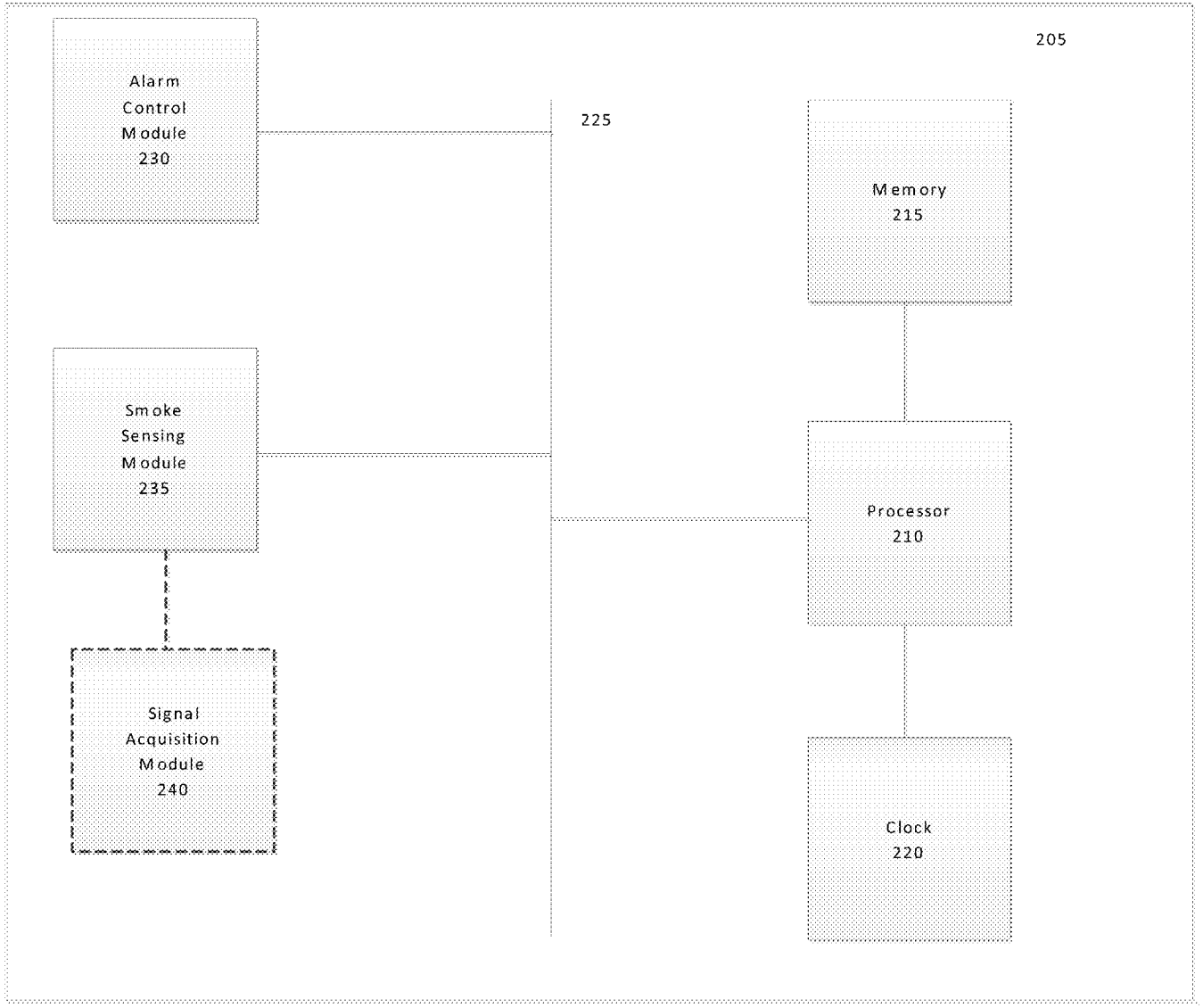
FIG. 2 shows an example of a smoke detector in accordance with aspects of the present disclosure.

FIG. 2 is an example block diagram of a smoke detector having self-adjustment and self-diagnostic capabilities. It should be readily apparent to one of ordinary skill in the art that the example detector depicted in FIG. 2 represents a generalized schematic illustration and that other components/devices/modules can be added, removed, or modified.

Referring to FIG. 2, detector 205 can include processor or microprocessor 210 in communication with memory 215 and clock 220. Memory 215 can include, for example, but limited to a nonvolatile memory, an electrically erasable programmable read-only memory and can be operable to store an instruction set and operating parameters for processor 210. Some of the operating parameter can be determined during a calibration procedure. The instruction set can also include the algorithm for drift compensation, discussed further below. Bus 225 can be operable to provide a communication pathway for alarm control module 230 and smoke sensing module 235. Smoke detector 205 can optionally include signal acquisition module 240 that can be in communication with smoke sensing module 235. Signal acquisition module 240 can be operable to convert or condition raw data, e.g., analog data, from smoke sensing module 235 into a digital form and then conveys that digital form to processor 210. Signal acquisition module 240 can include an analog-to-digital ("A/D") converter (not shown) to convert the analog output of light detector 120 to a digital form. If smoke sensing module 235 produces its raw data output in a form, whether analog or digital, that processor 210 can receive directly, then can convey that raw data directly to the processor 210, which produces from that raw data the digital representation on which it operates.

Processor 210 can be operable to activate smoke sensing module 235 to sample the smoke level in a region of chamber 105. Clock 220 in conjunction with processor 21*o* can set the sampling interval and duration. The sampling process can produce successive samples, each indicative of a smoke level at a respective one of successive sampling times.

The self-adjustment and self-diagnostic capabilities of smoke detector 205 depend on calibrating the sensor electronics and storing certain parameters in memory 215. During manufacture and/or maintenance of detector 205, a calibrated clear (clean) air voltage (CAV) can be obtained. This calibrated CAV measurement can be made in an environment known to be free or substantially free of smoke such that a clean air signal or clean air data sample that represents a 0% smoke level condition can be obtained. Based on the calibrated CAV, an alarm threshold can be set by processor 210 that corresponds to an output of smoke sensing module 235 which indicates the presence of excessive smoke in a region of detector 205 and in response to which an alarm condition produced by alarm control module 230 should be signaled. The calibrated values for CAV and the alarm threshold can be stored in memory 215.

A change in contamination or degradation in the sensing chamber over time causes smoke sensing module 235 to produce, in conditions in which smoke indicative of an alarm condition is not present, an output different from CAV. Whenever the output of smoke sensing module 235 in such conditions rises above the CAV measured at calibration, smoke detector 205 becomes more sensitive in that it will produce an alarm signal when the smoke level falls below the level to which the alarm threshold was set. This can cause unnecessary production of the alarm signal.

The self-adjustment process that processor 210 executes is designed to correct, within certain limits, for changes in sensitivity of smoke detector 205 while retaining the effectiveness of smoke detector 205 for detecting smoke. The self-adjustment process can determine an updated CAV value for smoke sensing module 235 over a data gathering time interval that can be used by processor 210 in the signaling of alarm control module 230.

Figure 3:
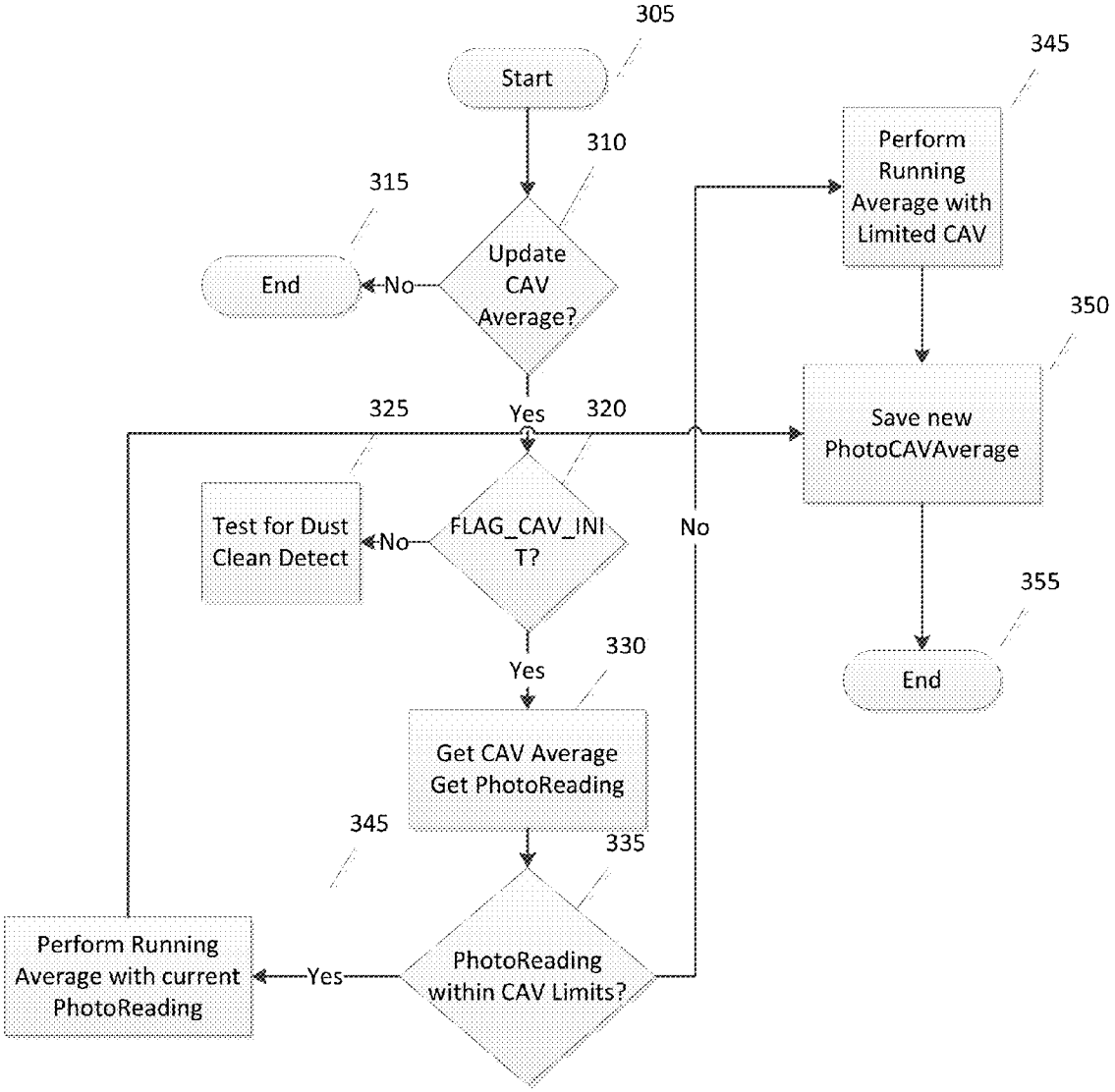
FIG. 3 shows an example clear air voltage averaging process in accordance with aspects of the present disclosure.

FIG. 3 shows an example process for smoke clear air voltage averaging implemented by processor 210 in accordance with aspects of the present disclosure. The process for smoke clear air voltage averaging is not performed if any one of the following conditions exists: 1) smoke fault detected; 2) fatal fault mode; 3) not in smoke standby state; or 4) smoke calibrated not complete. The smoke clear air voltage averaging can be performed every hour to average in the last Photo Reading with the CAV average. The CAV running average can be preserved in a non-reset memory. The CAV average can be used by the algorithm so it needs to be initialized at power on and reset button.

The process begins at 305. At 310, a determination is made as to whether to update clear air voltage (CAV) average. If the result of the determination at 310 is negative, meaning that the CAV average is not going to be updated, then the process can end at 315. If the result of the determination at 310 is positive, meaning that the CAV average is going to be updated, then the process proceeds to 320 where a determination is made as to whether a flag (FLAG_CAV_INIT) has been set. If the result of the determination at 320 is negative, meaning that the FLAG_CAV_INIT has been set, then the process can proceed to 325 where a test for dust clean detect is performed. If the result of the determination at 320 is positive, meaning that the FLAG_CAV_INIT has not been set, or after the test for clean detect has been performed, then the process proceeds to 330 where the CAV running average and last smoke chamber measurement (variable name "PhotoReading") are obtained. The process proceeds to 335 where a determination is made as to whether the last smoke chamber measurement (PhotoReading) is within CAV limits. The determination at 335 functions to limit an amount of CAV delta that is averaged into the running average. The CAV limits are set to prevent potential smoke from being averaged in to compensation CAV average. If the result of the determination at 335 is negative, meaning that the last smoke chamber measurement (PhotoReading) is not within CAV limits, then the process proceeds to 340 where a running average with limited CAV is performed. The current CAV change limit can be ±−4 A/D counts. The process then proceeds to 350 where the new reading (variable name "PhotoCAVAverage") is saved and the process ends at 355. If the result of the determination at 335 is positive, meaning that the last smoke chamber measurement (PhotoReading) is within CAV limits, then the process proceeds to 350 where the new smoke chamber measurement (PhotoCAVAverage) is saved and the process ends at 355.

Figure 4A:
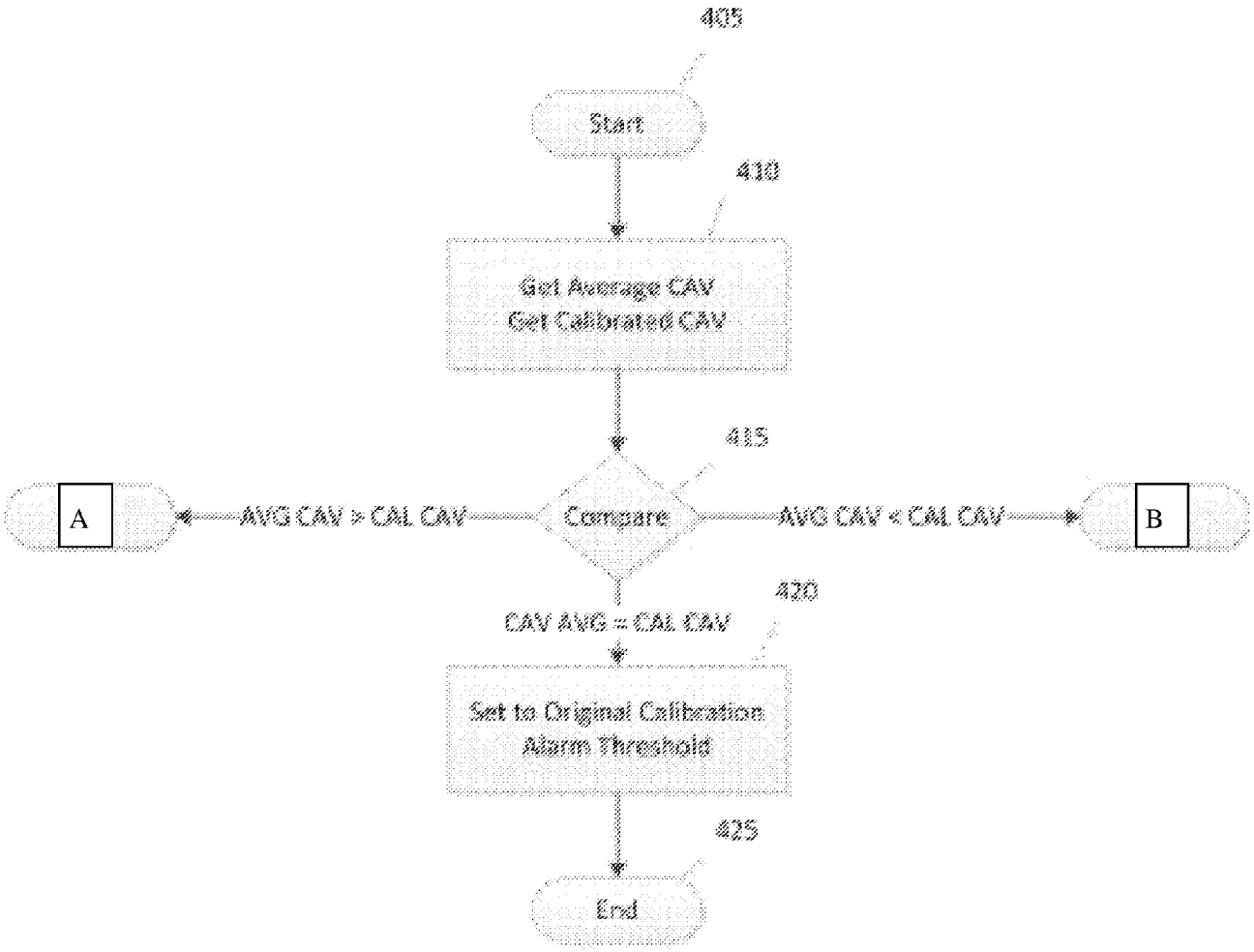
FIGS. 4A-4C show an example of a alarm threshold compensation process in accordance with aspects of the present disclosure.
Figure 4B:
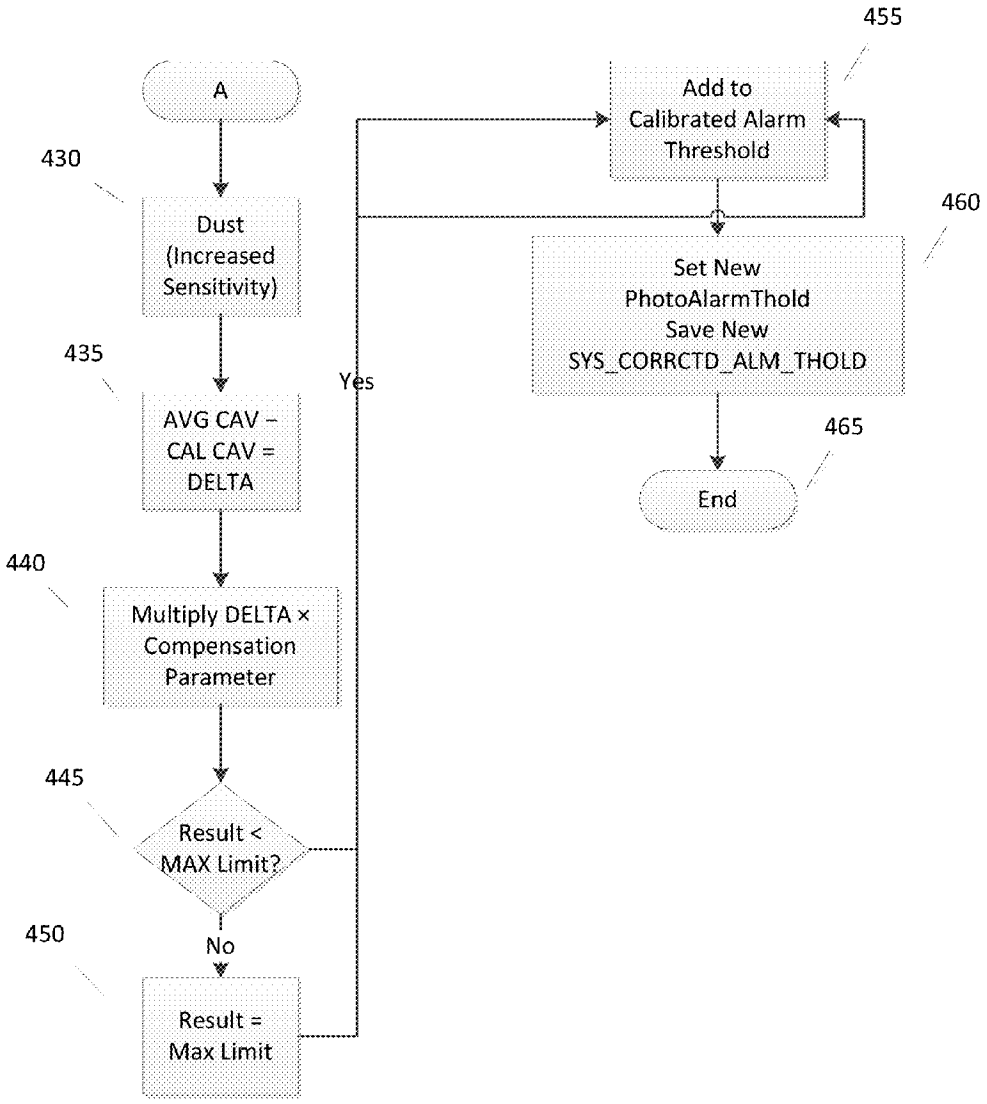
Figure 4C:
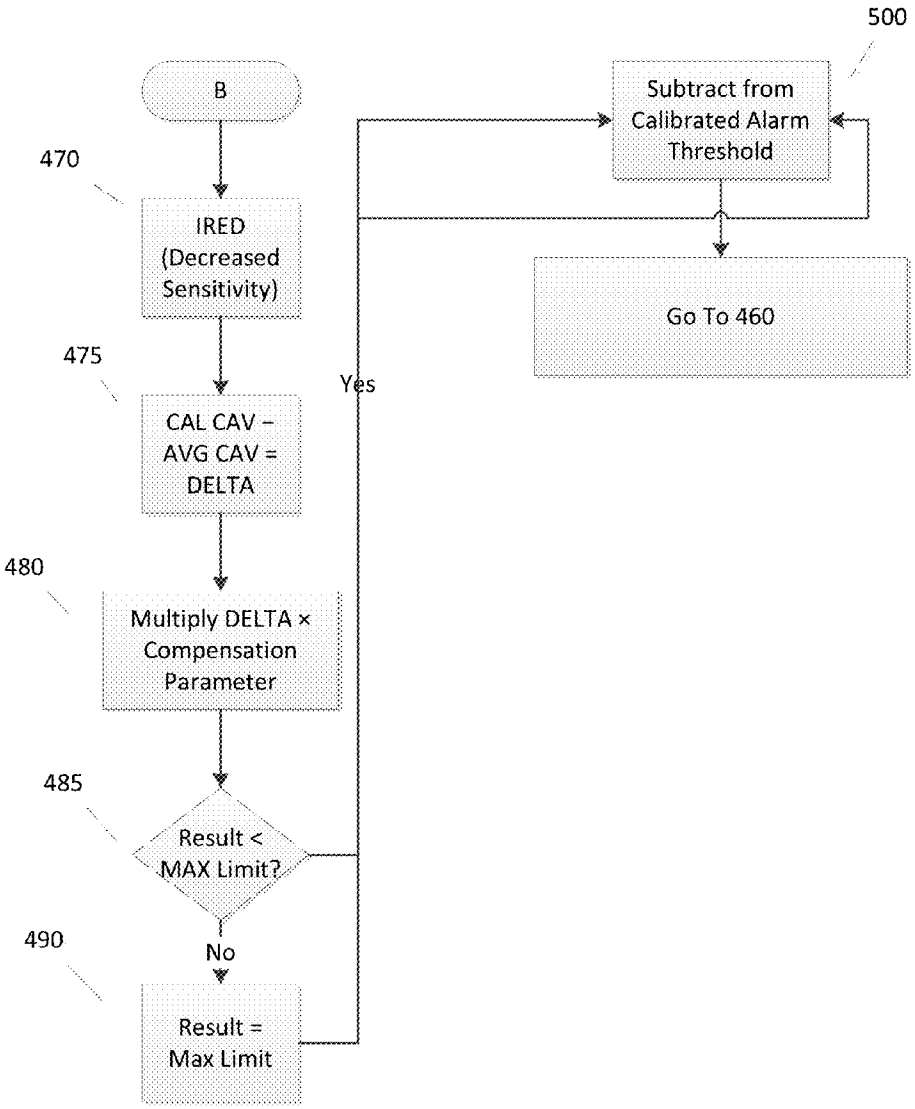

FIGS. 4A-4C show an example process for smoke alarm threshold compensation in accordance with aspects of the present disclosure. The smoke alarms threshold compensation can be called every 24 hours to adjust alarm threshold as needed as a result of the CAV drift. At 405, the process begins. At 410, average clear (clean) air voltage (CAV) and calibrated clear (clean) air voltage (CAV) is obtained. At 415, a comparison is made between the average clear air voltage (CAV) and calibrated clear air voltage (CAV). If the result of the comparison at 415 is that the average clear air voltage is equal to the calibrated clear air voltage then process proceeds to 420 where original calibrated alarm sensitivity is set and the process ends at 425.

If the result of the comparison at 415 is that the average clear air voltage is greater than the calibrated clear air voltage, then the process proceeds to 430 of FIG. 4B where the increased alarm threshold sensitivity is most likely due to dust or similar particulates. The difference (delta) between the average clear air voltage and the calibrated clear air voltage is determined by subtracting the calibrated clear air voltage from the average clear air voltage at 435. At 440, the delta determined at 435 is then multiplied by a compensation scale parameter or constant. The compensation scale constant can be a multiplication factor that can be the same slope used in the Smoke Calibration process to determine the original alarm Threshold. It can also be determined at calibration and also used during compensation adjustment.

At 445, a determination is made as to whether the result determined at 440 is less than a maximum alarm threshold sensitivity limit. The maximum alarm threshold sensitivity limit can be, for example, set at 50% of the clear air voltage to alarm shift that has been proposed by Underwriters Laboratories (UL). If the result of the determination at 445 is negative, meaning that the result of 440 is not less than the maximum alarm threshold sensitivity, then the result of 440 is set as the maximum alarm threshold sensitivity at 450. If the result of the determination at 445 is positive, meaning that the result of 440 is less than the maximum alarm threshold sensitivity, then the result of 440 is added to the calibrated alarm sensitivity threshold at 455. After the result of 440 is set as the maximum alarm threshold sensitivity at 450, the process proceeds to 455. At 460, the new variable ("PhotoAlarmThold") is set and the new SYS_CORRCTD_ALM_THOLD is saved. The process then ends at 465.

If the result of the comparison at 415 is that the average clear air voltage is less than the calibrated clear air voltage, then the process proceeds to 470 of FIG. 4C where the decreased alarm threshold sensitivity is most likely due to degradation of light source 110. The difference (delta) between the average clear air voltage and the calibrated clear air voltage is determined by subtracting the average clear air voltage from the calibrated clear air voltage at 475. At 480, the delta determined at 475 is then multiplied by a compensation scale parameter or constant, discussed above. At 485, a determination is made as to whether the result determined at 480 is less than a maximum alarm threshold sensitivity limit. The maximum alarm threshold sensitivity limit can be, for example, set at 50% of the clear air voltage to alarm shift that has been proposed by UL. If the result of the determination at 485 is negative, meaning that the result of 480 is not less than the maximum alarm threshold sensitivity, then the result of 480 is set as the maximum alarm threshold sensitivity at 490. If the result of the determination at 485 is positive, meaning that the result of 480 is less than the maximum alarm threshold sensitivity, then the result of 480 is subtracted from the calibrated alarm sensitivity threshold at 500. After the result of 480 is set as the maximum alarm threshold sensitivity at 490, the process proceeds to 500 and then to 460, as discussed above. At 460, the new PhotoAlarmThold is set and the new SYS_CORRCTD_ALM_THOLD is saved. The process then ends at 465.

The technical effects and benefits of embodiments relate to a self-adjustment and self-diagnostic capable smoke detector. The smoke detector can be operable to compensate for variations in smoke detection and alarm sensitivity likely produced by dust and similar particulates and light source degradation. The smoke detector can be operable to compare a running average of CAV with a calibrated CAV value and, based on the comparison, adjust the operation and performance of the smoke detector to compensate for drift in the alarm signal threshold.

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Some portions of the detailed description are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Embodiments of the present invention may include apparatuses for performing the operations herein. An apparatus may be specially constructed for the desired purposes, or it may comprise a general purpose computing device selectively activated or reconfigured by a program stored in the device. Such a program may be stored on a storage medium, such as, but not limited to, any type of disk including floppy disks, optical disks, compact disc read only memories (CD-ROMs), magnetic-optical disks, read-only memories (ROMs), random access memories (RAMS), electrically programmable read-only memories (EPROMs), electrically erasable and programmable read only memories (EEPROMs), magnetic or optical cards, or any other type of media suitable for storing electronic instructions, and capable of being coupled to a system bus for a computing device.

The processes and displays presented herein are not inherently related to any particular computing device or other apparatus. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the invention as described herein. In addition, it should be understood that operations, capabilities, and features described herein may be implemented with any combination of hardware (discrete or integrated circuits) and software.

Use of the terms "coupled" and "connected", along with their derivatives, may be used. It should be understood that these terms are not intended as synonyms for each other. Rather, in particular embodiments, "connected" may be used to indicate that two or more elements are in direct physical or electrical contact with each other. "Coupled" my be used to indicated that two or more elements are in either direct or indirect (with other intervening elements between them) physical or electrical contact with each other, and/or that the two or more elements co-operate or interact with each other (e.g. as in a cause an effect relationship).

The terminology used herein is for the purpose of describing particular embodiments only and is not intended to be limiting of the disclosure. While the description of the present disclosure has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the disclosure. Additionally, while the various embodiment of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A smoke detector comprising: a smoke detection chamber comprising:

a light source operable to provide radiation to an interior space of the smoke detection chamber, and a light detector operable to receive radiation scattered by one or more radiation scatting particles in the interior of the smoke detection chamber;

an alarm control module, in communication with the smoke detection chamber and a processor, operable to produce an alarm indicating a presence of a predetermined threshold of the one or more radiation scattering particles;

the detector configured to perform an alarm compensation threshold method comprising:

comparing a calibrated clear air voltage measurement with an average clear air voltage measurement;

adjusting an alarm threshold, based at least in part, on the comparison of the calibrated clear air voltage measurement and the average clear air voltage measurement;

wherein if the calibrated clear air voltage measurement is less than the average clear air voltage measurement, then an increased amount of dust in the smoke detector is indicated and the alarm threshold is increased;

the detector further configured to perform the averaging clear air voltage method comprising:

determining if the average clear air voltage measurement is to be updated;

obtaining, if the average clear air voltage measurement is determined to be updated, a new clear air voltage measurement from the smoke detection chamber; and updating the average clear air voltage using the new clear air voltage measurement;

wherein the average clear air voltage is not updated if one or more of the following conditions are detected: a smoke fault, a fatal fault, standby mode, smoke calibration mode not complete, or any detected abnormal operation or condition prevents CAY averaging.

2. The smoke detector according to claim 1, wherein the calibrated clear air voltage measurement is established in substantially zero percent smoke free environment and saved in the memory.

3. The smoke detector according to claim 1, wherein the average clear air voltage measurement is a running average of voltage measurements taken over a predetermined time period during cycles that are not related to dust accumulation or infrared LED degradation and saved in the memory.

4. The smoke detector according to claim 1, wherein if the calibrated clear air voltage measurement is greater than the average clear air voltage measurement, then a degradation of the light source is indicated and the alarm threshold is decreased.

5. The smoke detector according to claim 1, wherein the new clear air voltage measurement is obtained during a predefined time interval.

6. The smoke detector according to claim 1, wherein the predefined time interval is about every one hour.

7. The smoke detector according to claim 1, wherein the average clear air voltage measurement is a running average of voltage measurements taken over a predetermined time period during cycles that are not related to dust accumulation or infrared LED degradation and saved in the memory.

* * * * *